US007287351B1

(12) United States Patent
Warren

(10) Patent No.: US 7,287,351 B1
(45) Date of Patent: Oct. 30, 2007

(54) TACTICAL SIGHT FOR A SEMI-AUTOMATIC HAND GUN

(76) Inventor: Scott M. Warren, 15702 Beacon Ct., Montclair, VA (US) 22026

( * ) Notice: Subject to any disclaimer, the term of this patent is extended or adjusted under 35 U.S.C. 154(b) by 353 days.

(21) Appl. No.: 10/860,333

(22) Filed: Jun. 3, 2004

Related U.S. Application Data

(63) Continuation-in-part of application No. 10/228,100, filed on Aug. 27, 2002, now Pat. No. 6,834,457.

(51) Int. Cl.
*F41G 1/10* (2006.01)

(52) U.S. Cl. ..... 42/111; D22/110

(58) Field of Classification Search ..... D22/109, D22/110; 42/111, 133
See application file for complete search history.

(56) References Cited

U.S. PATENT DOCUMENTS

| | | | | | |
|---|---|---|---|---|---|
| 1,363,553 | A | | 12/1920 | Barringer | |
| 2,380,965 | A | * | 8/1945 | Harvey | 42/148 |
| 2,438,601 | A | * | 3/1948 | Davis | 42/137 |
| 2,494,163 | A | * | 1/1950 | Davis | 42/137 |
| 3,495,339 | A | * | 2/1970 | Elliason | 42/137 |
| 3,698,092 | A | * | 10/1972 | Rosenhan | 42/132 |
| 3,840,995 | A | * | 10/1974 | Freiling | 42/148 |
| D273,217 | S | | 3/1984 | Swenson | |
| 4,691,442 | A | * | 9/1987 | Center | 42/140 |
| D296,227 | S | | 6/1988 | Novak | |
| D301,512 | S | | 6/1989 | Novak | |
| D305,146 | S | | 12/1989 | Novak | |
| D305,561 | S | | 1/1990 | Novak | |
| D315,776 | S | | 3/1991 | Novak | |
| D351,449 | S | | 10/1994 | Dagley | |
| 5,359,800 | A | * | 11/1994 | Fisher et al. | 42/145 |
| 5,467,552 | A | * | 11/1995 | Cupp et al. | 42/125 |
| 5,822,872 | A | | 10/1998 | Waki | |
| D403,734 | S | | 1/1999 | Kay | |
| 6,035,539 | A | | 3/2000 | Hollenbach et al. | |
| D423,630 | S | * | 4/2000 | Flubacher et al. | D22/109 |
| D432,618 | S | | 10/2000 | Wilson | |
| D436,393 | S | | 1/2001 | Ling, Jr. | |
| 6,216,351 | B1 | | 4/2001 | Flubacher et al. | |

OTHER PUBLICATIONS

*Wilson Combat* 2001 Master Catalog, cover and selected pp. 71-73.

* cited by examiner

*Primary Examiner*—Stephen M. Johnson
(74) *Attorney, Agent, or Firm*—Fay Sharpe LLP

(57) ABSTRACT

A rear tactical sight for a handgun having a barrel with a barrel axis. The sight including a base extending in a longitudinal direction parallel to the barrel axis. The base having a front and an oppositely facing back with sides extending in the longitudinal direction between the front, the back and a bottom. The sight further including an upwardly opened notch joined to the base and spaced above the base bottom which at least partially defines boundaries of a sight line for the sight and a pair of side walls spaced on either side of the sight line each having outer surfaces that are opposite to one another and which extend upwardly from the base sides. The outer surfaces being substantially symmetrical to one another and each including a first arcuate surface extending upwardly and inwardly from a corresponding one of the base sides respectively and a second arcuate surface extending inwardly and upwardly from the first surface.

19 Claims, 6 Drawing Sheets

TACTICAL SIGHT FOR A SEMI-AUTOMATIC HAND GUN

This application is a Continuation-In-Part application of patent application Ser. No. 10/228,100 filed on Aug. 27, 2002 now U.S. Pat. No. 6,834,457.

The present invention relates to the art of gun sights and, more particularly, to a gun sight for a semi-automatic handgun used for tactical applications, where quick target acquisition and quick sight alignment are critical and wherein the sight is subjected to many adverse conditions and situations.

INCORPORATION BY REFERENCE

The present invention relates to a gun sight for a semi-automatic handgun for tactical applications. Such gun sights are known in the art and are generally shown and described in Flubacher U.S. Pat. No. 6,216,351 which is incorporated by reference herein as background information illustrating a front and rear sight for a semi-automatic handgun including the interengagement between the sight and the slide of the handgun. Barringer U.S. Pat. No. 1,363,553; Waki U.S. Pat. No. 5,822,872 and Hollenbach U.S. Pat. No. 6,035,539 are incorporated by reference herein as background information showing different rear sight configurations along with the interactions between the front and rear sights. The Novak patents Des. 305,561; Des. 296,227; Des. 305,146; Des. 315,776 and Des. 301,512, Ling, Jr. Des. 436,393 and Swenson Des. 273,217 are incorporated by reference herein as background information illustrating rear tactical sights, and the dovetail, dovetail cut connection between the rear gun sight and the slide of the handgun.

Also incorporated by reference herein as background information illustrating tactical gun sights is the cover and several selected pages from Wilson Combat 2001 Master Catalog. The Wilson Combat catalog illustrates several tactical gun sights along with the mechanical structure of the semi-automatic handgun.

BACKGROUND OF THE INVENTION

The present invention is particularly applicable for use in connection with semi-automatic handguns, which are used for tactical applications, and, therefore, the invention will be described with particular reference to tactical semi-automatic handguns. However, the invention has broader applications and may be used with any type of handgun and other firearms.

It is, of course, well known that a sight is necessary to accurately aim the barrel of a firearm that is being fired. It is also well known, proven and taught in tactical training, that use of any firearm in tactical applications necessitates quick threat or target acquisition and quick sight alignment. Furthermore, quick threat or target acquisition and quick sight alignment are also important when moving the firearm from a first target to a second target. It should be appreciated that in tactical situations, when lives are at stake, minimizing the time necessary to obtain a target or threat and align the sights are critical.

Traditional rear sights are typically square, boxy and include sharp corners. As a result, when utilizing a traditional rear sight, due to it's large top edge, the user's eye must search along that large top edge of the sight blade to locate the front sight. This lengthens time necessary to locate the front sight. In addition, the large rectangular rear portion of prior art gun sights acts as an obstruction, which reduces the ability to see the threat about the peripheral portions of the sight. When handguns are fired, typically at an arm's length from the user, a large bulky rear sight reduces the ability to fully see the target, especially when it is small and/or distant or when the user needs to distinguish if the threat is armed. In this respect, large boxy rear sight configurations may make it necessary for the user to actually lower the handgun so that the user can see over the top of the sights for target acquisition and then raise the handgun to align the sights. This, in addition to the user searching a large top edge of the sight to locate the front sight, takes significant time under tactical, life threatening circumstances and therefore disadvantageously increases the time necessary for target acquisition and sight alignment. Prior art gun sights also include eye distracting configurations and textures on the rear facing surface of the sight which produces time consuming distractions to the user's eye. In this respect, sharply square outer corners have a tendency to draw the user's eye to the corners of the gun sight, momentarily distracting the user, while the user is attempting to locate the front sight and align it in the notch of the rear sight. Textures and other configurations or contours on the rear surface of the sight have a similar effect. While some prior art sights such as Swenson, utilize textures to reduce glare, the textures tend to produce an eye distraction, disadvantageously increasing the threat acquisition time and sight alignment time.

The notch of the rear sight is used to define the boundaries of a sight line, which in connection with the front sight, allows the user to properly align the barrel towards the target. Prior art notches fall in two general categories, namely, semi-circular notches and rectangular notches. Semi-circular notches are difficult to align since there are no sidewalls to reference against the sides of the front sight. The sidewalls of the rear notch are used as parallel references to the sides of the front sight to ensure that the handgun's barrel is properly aligned from left to right. This is done by having an equal open space between the left side edge of the front sight to the left side edge of the rear notch wall as between the right side edge of the front sight to the right side edge of the rear notch wall. With a semi-circle, proper alignment is not easily definable, since the front sight is referenced, to merely a portion of a round shape. However, while prior art rectangular notches provide better reference based on the side edges, it has also been found that square corners at the bottom of the notch detract the user's eye in that the eye is drawn to the sharp corners. As stated above, sharp corners momentarily distract the user eye, while the user is attempting to locate the front sight. This same distraction comes from looking through a notch with sharp bottom corners. Another problem with the prior art sight relates to the length of the notch. Notches which have a long length produce more of an obstruction to the sight line which increases the amount of time necessary for target acquisition and for finding the front sight. Turning to the width of the notch, rear notches which are substantially wider than the width of the front sight make it difficult to center the front sight within the notch which also adds to the time necessary for target acquisition.

Another aspect of tactical gun sights relates to the fact that these sights are often used in many different types of adverse conditions and situations. With respect to adverse conditions, while target or threat acquisition is important, the tactical gun sight must also be designed to withstand the harsh conditions in which the firearms are often used. More particularly, tactical handguns are designed for use by military and law enforcement personnel and other individuals in the field. This involves transporting the firearm and using the firearm over many uncertain terrains and in connection with many uncertain obstacles. Further, due to the adverse conditions, the firearm can be dropped and/or be engaged against the terrain and/or obstacles. As a result, the gun sight must be robust and accurately tied to the slide mechanism of the handgun to maintain accuracy.

SUMMARY OF THE INVENTION

In accordance with the present invention, provided is a rear gun sight for use in connection with a tactical semi-automatic handgun which includes configurations that minimize sight obstructions and that quickly direct and focuses the user's sight to the sight line and front sight.

More particularly, a sight according to the present invention is configured to maximize the visual ability of the user to see past the rear sight for both target acquisition and front sight location by minimizing the cross-sectional configuration of the sight. In this respect, a rear surface minimizing design is incorporated on either side of the notch. This minimizing design greatly reduces the visual obstructions near the notch, so that the user can more quickly obtain target acquisition. The user's vision is now directed by the flow of the minimizing design and the resulting narrowness of the sight top to the sight line and front sight. Essentially the upper portion of the gun sight contains only the notch.

In this respect, according to one aspect of the present invention, the sight includes a base having a back and an oppositely facing front with sides extending between the back and the front. The sight further includes an upwardly open notch joined to the base and spaced above the base bottom which at least partially defines boundaries of a sight line for the sight. The sight further includes a pair of side walls spaced on either side of the notch which have outer surfaces that are opposite to one another and which are generally symmetrical. These outer surfaces include a first surface extending upwardly and inwardly from a corresponding one of the base sides, respectively, and a second surface extending inwardly and upwardly from the first surface.

According to another aspect of the present invention, the rear tactical sights can include an upwardly open notch having a substantially horizontal notch base transverse to the longitudinal direction and substantially vertical notch sides adjacent either side of the notch base wherein the sides are joined to the notch base by symmetrical, arcuate corner surfaces.

In accordance with yet another aspect of the present invention, a rear tactical sight is provided including an upwardly open notch joined to the base and spaced above the base bottom which at least partially defines boundaries of a sight line for the sight and a pair of side walls spaced on either side of the sight line each having outer surfaces that are opposite to one another and which extend upwardly from the base sides. The outer surfaces being substantially symmetrical to one another and each having an outer surface. The outer surfaces can include a convex surface portion having a lower edge adjacent one of the base sides, respectively, and an upper edge adjacent to a concave surface portion. The convex surface portion extending upwardly and inwardly from the respective side and the concave surface portion extending inwardly and upwardly.

BRIEF DESCRIPTION OF THE DRAWINGS

The foregoing objects, and others, will in part be obvious and in part be pointed out more fully hereinafter in connection with a written description of preferred embodiments of the present invention illustrated in the accompanying drawings in which.

DESCRIPTION OF THE PREFERRED EMBODIMENTS

Figure 1:
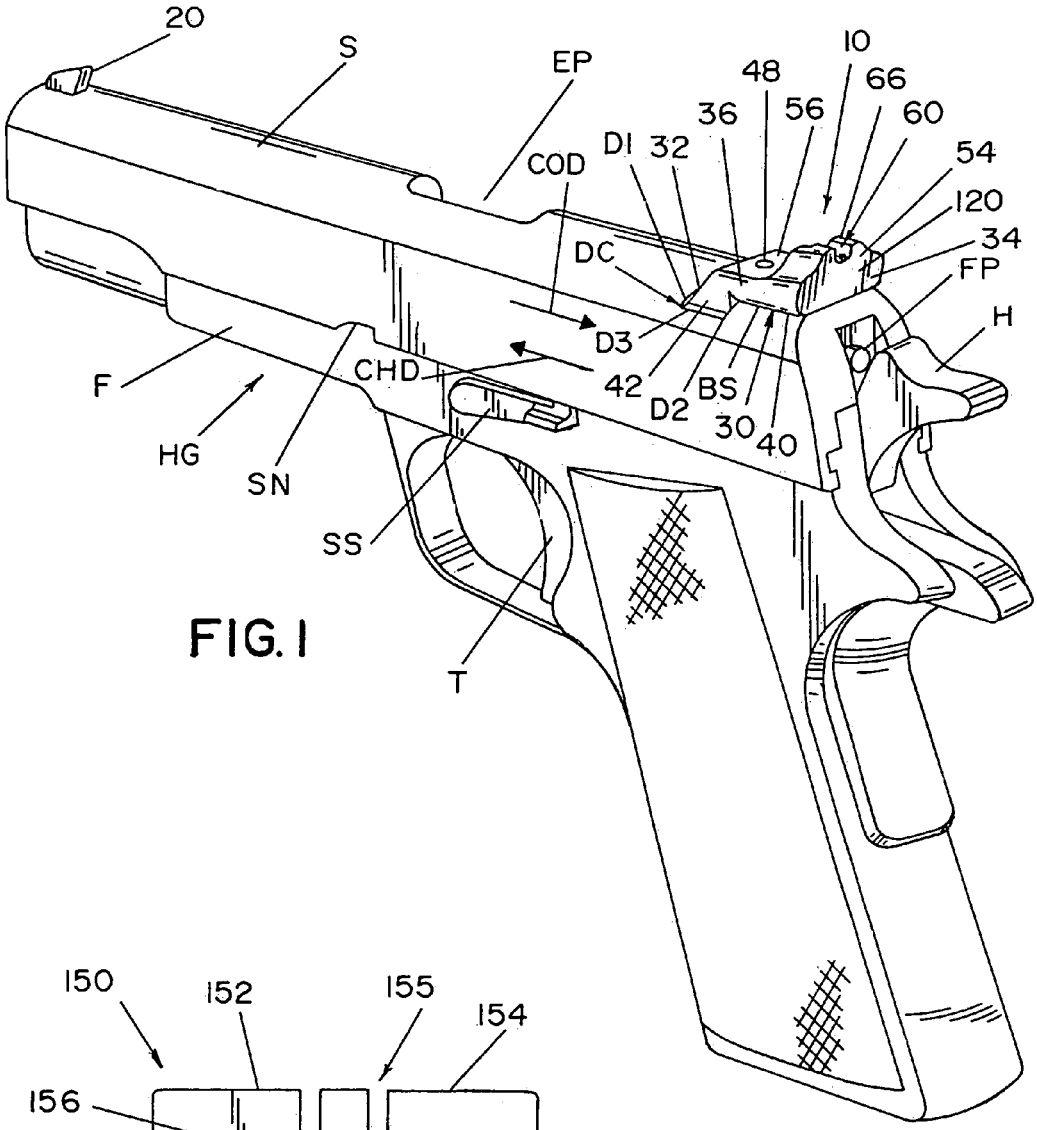
FIG. 1 is a rear perspective view of a semi-automatic handgun shown mounted with a tactical gun sight in accordance with the present invention.

Referring now in greater detail to the drawings wherein the showings are for the purpose of illustrating preferred embodiments of the invention only, and not for the purpose of limiting the invention, FIG. 1 shows a semi-automatic handgun HG and slide S with a rear tactical sight 10 and a front tactical sight 20 mounted thereon. A dovetail cut DC and a base surface BS are machined into a portion of the top surface of slide S which allows rear sight 10 to be rigidly secured to slide S and to be precisely oriented relative to a barrel (not shown) for firing accuracy. However, while a dovetail may be preferred, it is not necessary for the invention of this application.

Slide S moves relative to a frame F of handgun HG rearwardly in a cocking direction COD to extract and eject a spent cartridge (not shown) from the barrel and to simultaneously cock a hammer H. When this rearward motion is complete, slide S then moves forwardly in a chambering direction CHD to chamber a new round in the barrel. In this respect, when a trigger T is depressed, hammer H pivots forwardly against a firing pin FP which impacts the rear of the chambered round, causing the round to discharge from the barrel. The explosive force of the discharged round, automatically forces slide S rearwardly in cocking direction COD wherein the now spent round is extracted from the chamber and then ejected from an ejection port EP and hammer H is cocked. In addition, a slide recoil spring (not shown) is compressed during this rearward movement. As a result, once slide S has completed it's rearward travel, the now compressed recoil spring produces a forward acting force which urges the slide forward in chambering direction CHD. As slide S is moving forward, it strips a new round from the magazine, feeds that round into the chamber and then seats the round in the chamber, or in one word "chambers" the round. Therefore, if every thing is working properly, each time handgun HG is fired, the spent cartridge is automatically ejected, the hammer is automatically cocked and a new round is automatically chambered in the barrel.

Once all of the rounds are discharged from the magazine, a magazine follower (not shown) is exposed to apply an upward pressure on slide stop SS. As a result, when slide S completes it's rearward most travel in cocking direction COD, a slide stop SS engages and catches a slide stop notch SN thereby retaining slide S in a "locked back" position (not shown). After the empty magazine has been discharged, a full magazine is loaded in handgun HG. The user then depresses slide stop SS and the compressed slide spring forces slide S forward, relative to the frame F, in chambering direction CHD which chambers the top round of the full magazine.

Turning to FIGS. 2 and 4-8, rear sight 10 includes a base 30 having a front 32 and a back 34 with sides 36 and 38 extending in a longitudinal direction L between front 32 and back 34. Base 30 further includes a bottom 40 having a dovetail 42, which interengages with dovetail cut DC in slide S. However, it should be appreciated that other mounting arrangements known in the art can be used in connection with the sights of this application. Furthermore, the dovetail of sight 10 can be positioned anywhere on base 30 without detracting from the invention of this application. In this respect, based on the slide configuration of the gun, it may be advantageous to reposition the dovetail to help better position the gun sight on the gun. Bottom 40 is closely adjacent to base surface BS. The interengagement is facilitated by a front dovetail surface 44 and a rear dovetail surface 46, which slope upwardly towards one another at an angle similar to the angle of the inwardly facing surfaces D1 and D2 of dovetail cut DC. Base 30 further includes a threaded hole 48 centered in the longitudinal direction between surfaces 44 and 46 for accepting a threaded fastener 50. Rear sight 10 is secured to slide S by directing dovetail 42 transversely of direction L into dovetail cut DC until rear sight 10 is properly aligned with the barrel. Threaded fastener 50 is then threaded into hole 48 until it engages a bottom surface D3 of dovetail cut DC thereby urging dovetail surfaces 44 and 46 upwardly against surfaces D1 and D2 respectively. This rigidly secures sight 10 to slide S and properly aligns sight 10 longitudinally with the barrel. Base 30 further includes a front base surface 52 which is angled rearwardly, a back base surface 54 which is opposite to front surface 52 and a top surface 56 adjacent to front surface 52. The edge between front surface 52 and top surface 56 is broken or softened for clearing a "stove pipe jam" which will be discussed in greater detail below.

Extending upwardly from base 30 are walls which define sight boundaries of a sight line SL for target acquisition and which include a notch 60. More particularly, side walls 62 and 64 extend upwardly from base 30 near base back 34 and are joined by notch wall 66. Side walls 62 and 64, each include outer surfaces 68 and 70, respectively, that are essentially symmetrical to one another and have an inwardly tapered configuration. In this respect, outer surfaces 68 and 70 include a first inwardly extending surface 72 and 74 having a lower edge 76 and 78 adjacent to base sides 36 and 38 respectively. Preferably, first inward surfaces 72 and 74 are radiused with a radius of approximately 0.0625 inches. Outer surfaces 68 and 70 further include a second upwardly extending surface 80 and 82, respectively, adjacent to first surfaces 72 and 74 and which are also arcuate such that the respective outer surfaces include a convex surface portion having a lower edge adjacent one of the base sides and an upper edge adjacent to a concave surface portion. The convex surface portion extending upwardly and inwardly from the respective side and the concave surface portion extending inwardly and upwardly from the convex surface portion. It is preferred that surfaces 80 and 82 are radiused with a radius of 0.2187 inches. Adjacent to second surfaces 80 and 82 are third surfaces 84 and 86, respectively, which extend inwardly and are arcuate. Preferably, third surfaces 84 and 86 are radiused with a radius of approximately 0.0625 inches. Third surfaces 84 and 86 blend into top surfaces 88 and 90, respectively, which are coplanar with a notch wall top surface 92.

Figure 6:
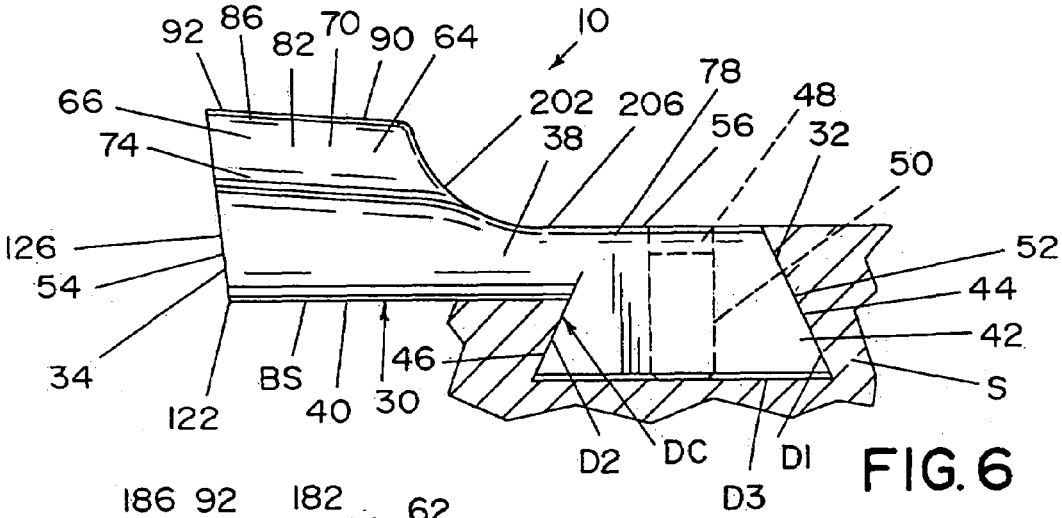
FIG. 6 is a side elevational view of the gun sight shown in FIG. 4.
Figure 7:
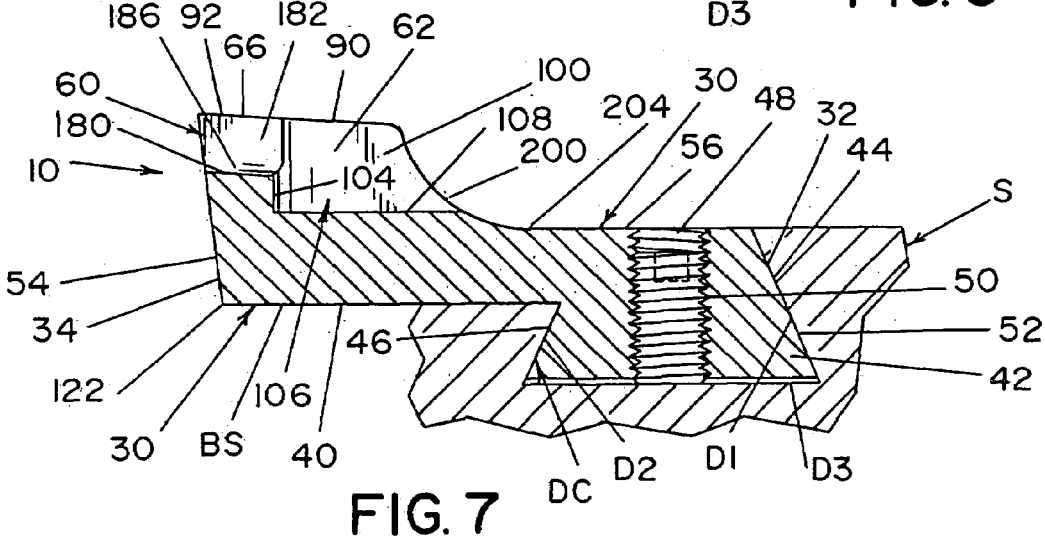
FIG. 7 is a sectional elevational view taken along line 7-7 in FIG. 5.
Figure 8:
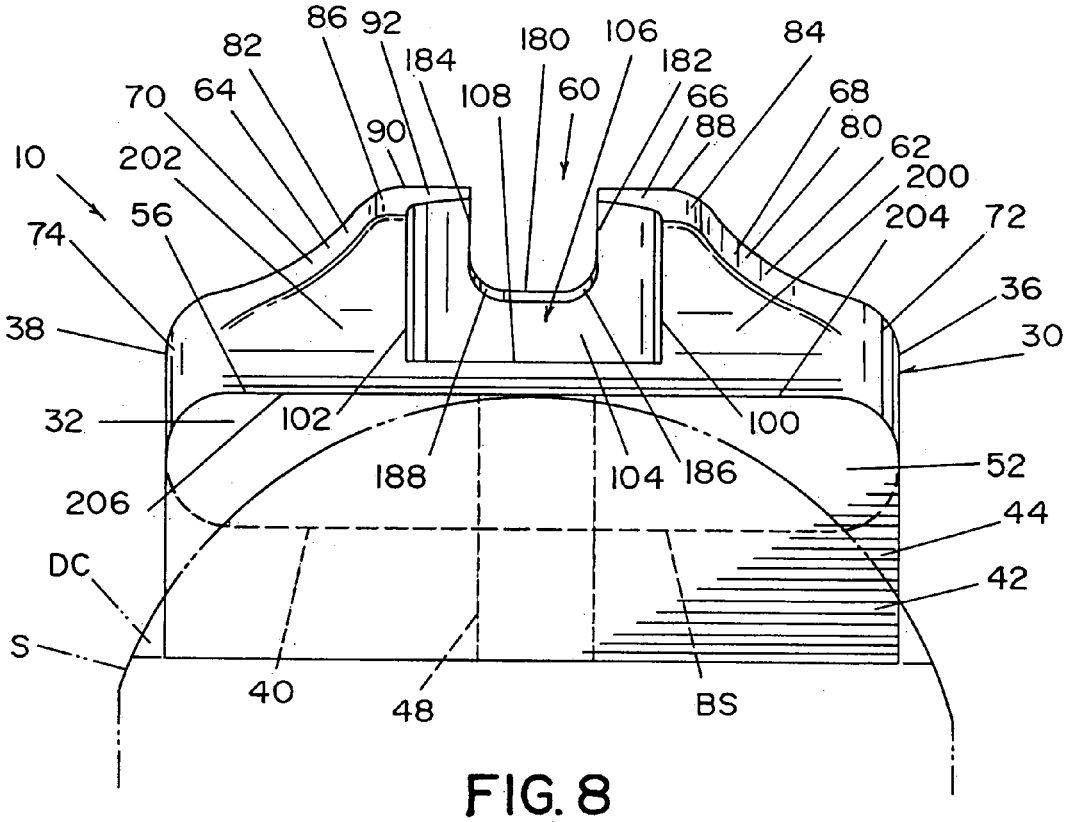
FIG. 8 is a front elevational view of the rear tactical gun sight as shown in FIG. 1.

Referring to FIG. 6, top surfaces 88, 90 and 92 are angled downwardly from rear to front at approximately a 4 degree angle. This 4 degree top slope is provided so that the user does not injure themself when clearing a "stove pipe jam" (SPJ). This slope can be in the range of 0-8 degrees. Also, when aligning the sights, this angle gives the user distinct, crisp edges, free of distortion. A flat or horizontal top surface can appear blurry or not easily distinguishable. As stated above, a SPJ involves a spent cartridge, open end up, that failed to be completely ejected from the ejection port EP. The base of the cartridge is resting on the top round in the magazine and it's body is jammed between the slide's breach face (not shown) and the barrel's hood (not shown). Accordingly, the user must then dislodge or clear the spent cartridge so the slide can complete it's forward travel to completely chamber the new round. The "stove pipe" round is cleared by first positioning the user's weak hand's fingers on top of slide S, with the palm facing down so that the stove piped cartridge is between the user's hand and body. Next, with a rapid and forceful motion, the user snaps the positioned hand toward their body so that, the index finger or the palm of the hand, engages the protruding portion of the "stove piped" cartridge. This forceful snapping motion dislodges the cartridge, allowing slide S to travel forward in chambering direction CHD and seat the new round. The force generated by the hand in the above motion and the close proximity to the top of slide S, always carries the hand into and over rear sight 10. The broken or softened edges discussed above and the 4 degree top slant, greatly reduce the likelihood that the user's hand will be injured.

Side walls 62 and 64 further include inwardly facing surfaces 100 and 102, respectively, and notch wall 66 includes a forwardly facing front surface 104 which together form a U-shaped clearance groove or channel cut 106. Clearance groove 106 is further defined by a clearance groove bottom 108 that is spaced slightly above base top 56. Clearance groove 106, along with notch 60 defines sight boundaries for sight line SL which will be discussed in greater detail below. In addition, clearance groove 106 has a width transverse the direction L in a length in line with direction L. Both the length and the width of clearance groove can vary according to the desired amount sight boundary. Shown is a wide clearance groove arrangement which provides a minimal amount of sight boundary. Furthermore, forwardly facing front surface 104 can be curved and can have a radius of 0.125 inches. With this curved surface 104, clearance groove 106 has a width transverse to the longitudinal direction which is approximately 0.250 inches.

Figure 2:
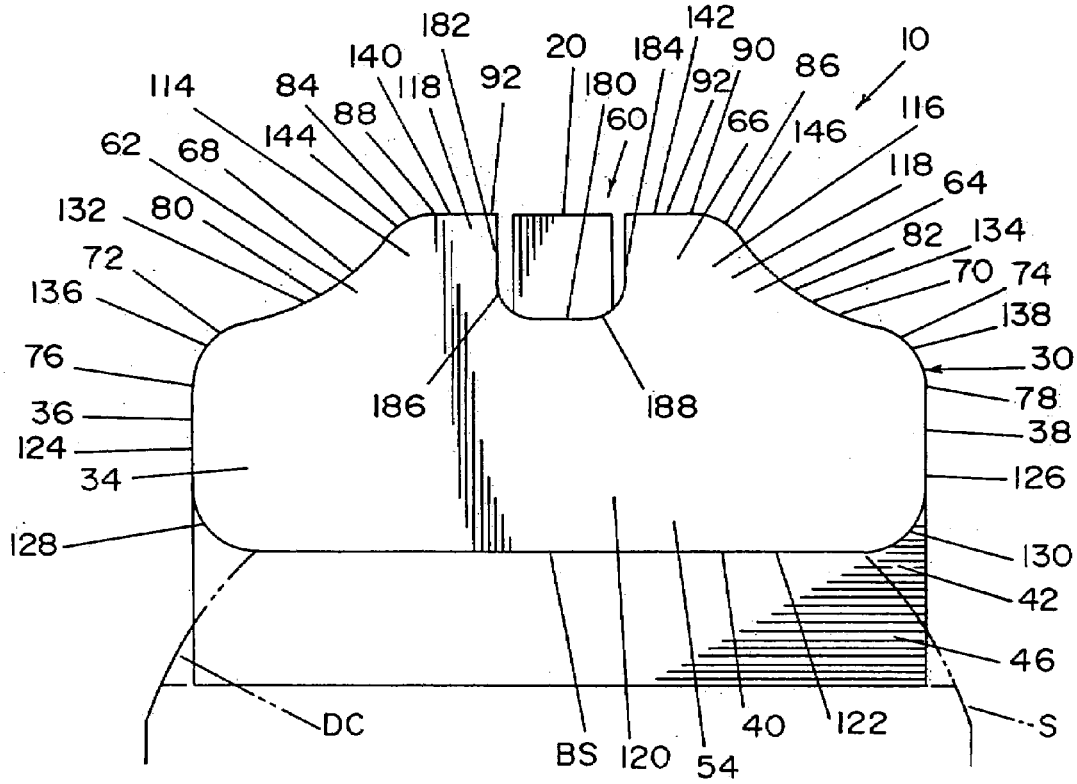
FIG. 2 is an enlarged rear elevational view of the rear sight shown in FIG. 1 in alignment with a front sight.

Sidewalls 62 and 64 and notch wall 66 have back surfaces 114, 116 and 118, respectively, which are contiguous to another and to back surface 54 thereby forming rear sight surface 120 that extends upwardly from base bottom 40 to top surfaces 88, 90 and 92. Preferably, surfaces 114, 116, 118 and 54 are coplanar thereby making surface 120 a generally flat surface. Referring particularly to FIGS. 2 and 6, rear surface 120 has a rearward slope from bottom to top which is preferably 7 degrees from vertical. However, rear surface 120 can be sloped in the range of 4-10 degrees from vertical or in the range of 6-8 degrees from vertical. This reduces glare without the use of eye distracting grooves, ridges or other contours. The outer configuration or peripheral edge of sight surface 120 is rounded to minimize the amount of eye distracting corners or sharp edges. In this respect, surface 120 has a bottom edge 122 adjacent base bottom 40 and has side edges 124 and 126 which are adjacent to sides 36 and 38 respectively. Bottom edge 122 is joined to side edges 124 and 126 by arcuate corner edges 128 and 130 respectively. It is preferred that corner edges 128 and 130 are radiused with a radius of 0.0625 inches. However, these arcuate corner edges can have a radius in the range of 0.040 inches to 0.090 inches. Rear surface 120 further includes upper edges 132 and 134 which are adjacent to outer surfaces 68 and 70 respectively. Edges 132 and 134 are joined to side edges 124 and 126 by arcuate corner edges 136 and 138 respectively. As with corner edges 128 and 130, corner edges 136 and 138 are preferably radiused with a radius of 0.0625 inches. These corner edges can have a radius in the range of 0.040 inches to 0.090 inches. Also, while the radius of corner edges 128, 130, 136 and 138 can vary, it is preferred that they are generally equal to each other. Rear surface 120 further includes top edges 140 and 142 which are preferably horizontal and in line with one another. Edges 140 and 142 are blended into edges 132 and 134, respectively, by arcuate edges 144 and 146 respectively. The result is that edges of rear surface 120 are flowing and direct the user's eye toward notch 60.

Figure 3:
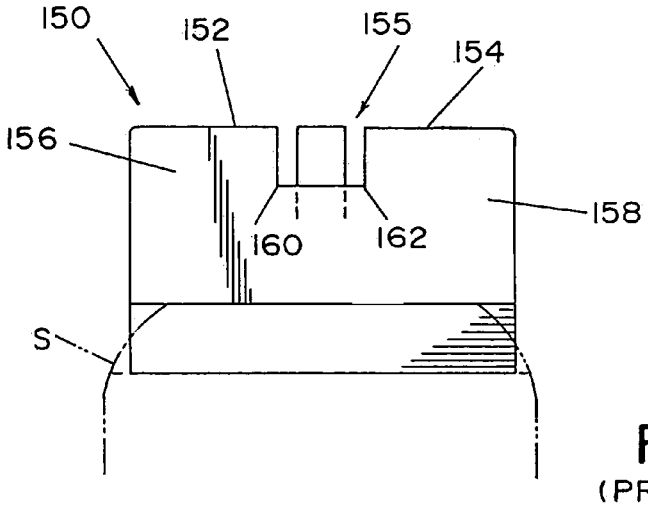
FIG. 3 (PRIOR ART)
FIG. 3 is a rear elevational view of a prior art gun sight in alignment with a front sight.

Due to the inward taper of outer surfaces 68 and 70, rear surface 120 is very narrow near top edges 140 and 142 to prevent the user from having to spend time searching the top edge of the rear sight for the target or for the front sight. More particularly, referring to FIG. 3, a prior art sight 150 is shown. As can be seen, prior art sight 150 includes substantial top edges 152 and 154 which forces the user to spend time searching the top edge for the front sight or notch 155. In addition, by including rectangular side walls 156 and 158 a substantial amount of the user's vision is blocked. This also increases the amount of time it takes the user to both find the front sight and to acquire a view of the target which under tactical situations can be deadly.

Figure 4:
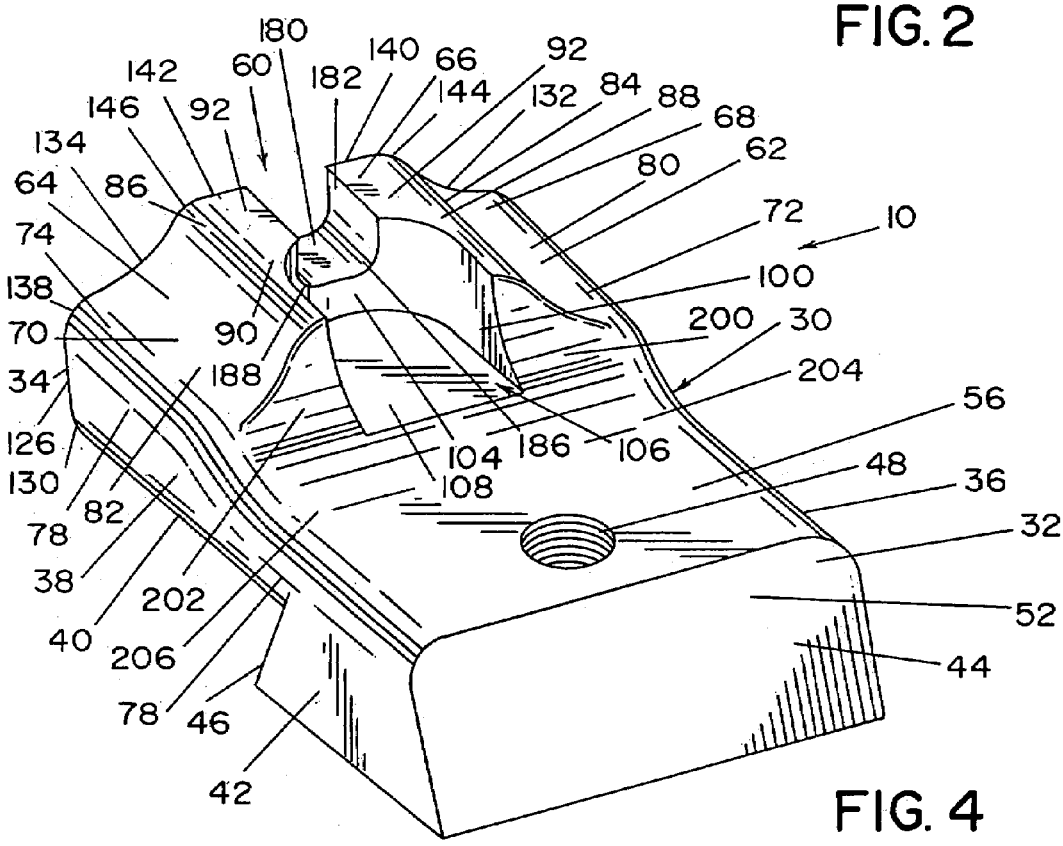
FIG. 4 is a detailed front perspective view of a rear tactical gun sight according to the present invention.
Figure 5:
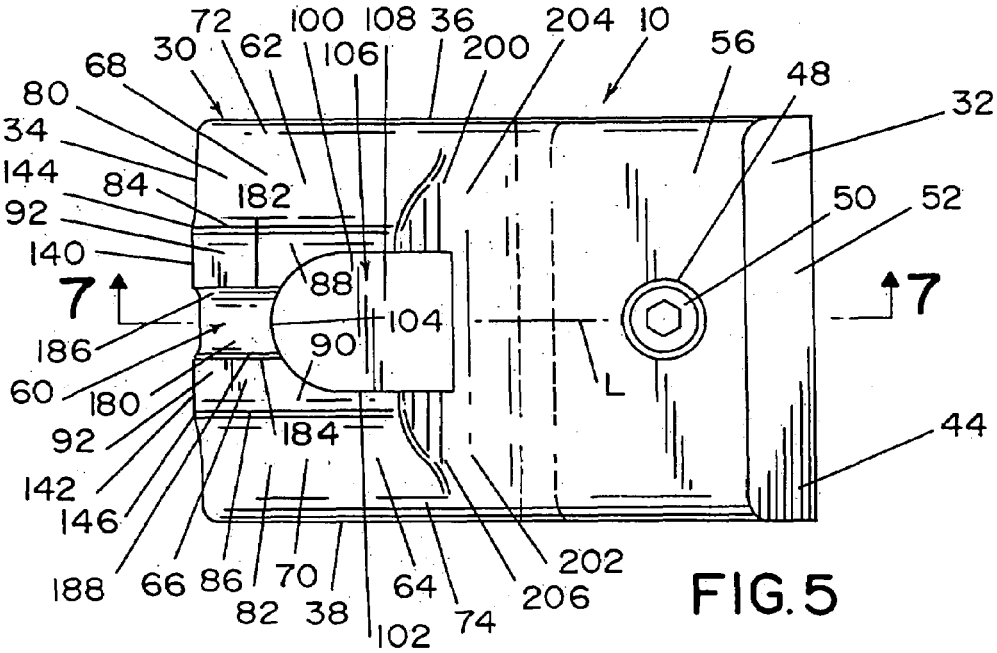
FIG. 5 is a top plan view of the gun sight shown in FIG. 4.

Referring to FIGS. 2 and 4, Notch 60 of the invention of this application is an upwardly opened notch, which is centered horizontally in rear surface 120. Notch 60 is defined by a notch base surface 180 which is essentially horizontal and notch side surfaces 182 and 184 that are essentially vertical. Notch base 180 is joined to notch sides 182 and 184 by arcuate corner portions 186 and 188 respectively. It is preferred that corner portions 186 and 188 are radiused and can have a radius of 0.0469 inches. However, corner portions 186 and 188 can be radius in the range of 0.030 inches to 0.060 inches. Base 180 is a planar surface that is slightly angled from back to front. The slight angle from back to front produces a crisp, well defined notch base as the user looks through notch 60 towards front sight 20. In addition, as discussed above, top surfaces 88, 90 and 92 are also angled downwardly from back to front which not only prevents injury while clearing a "stove pipe jam," but also produces a clear, crisp and distinct edge for the user when looking through rear sight 10, toward front sight 20. Furthermore, the shooters could be distracted by seeing a horizontal plane on the top of sight 10. Notch 60 has a width transverse to the longitudinal direction, between sides 182 and 184, of preferably 0.125 inches and a length in the longitudinal direction which is preferably 0.125 inches. As will be discussed in greater detail below, by reducing the notch length to 0.125 inches, as compared to prior art sights, sight boundaries are further reduced.

Comparing prior art site notch 155 to notch 60 of this application shows one aspect of why sight 10 of this application allows the user to more quickly obtain target acquisition and sight alignment. In this respect, aligning sights 10 and 20 on a target involves aligning the front and rear sights horizontally and vertically. With respect to horizontal alignment prior art sight 150 includes square corner edges 160 and 162. Conversely, sight 10 includes arcuate corners, portions 186 & 188, which assist the user by directing the user's eye upward to front sight 20. This provides the user with a better frame of reference, by directing the vision upward to the top of notch 60 and the top of front sight 20.

Prior art notches which are semicircular (not shown) are also difficult to align horizontally due to the judgment necessary to determine whether the front sight is centered. By not including vertical sidewalls, the user has no, or substantially diminished, side references to align the front sight in the rear notch and also to adjust for windage. Also, during the process of "breaking the shot," which refers to the process of maintaining sight alignment while the trigger is being pressed if pressure is not evenly applied to the trigger, sight misalignment can occur. More particularly, if the trigger press is not exactly straight back in that it is applied to either side of the trigger, the pressure is transferred throughout the handgun. This often results in handgun HG becoming misaligned and the shot being off. However, by including vertical side walls, the user is better able to observe that something is going wrong in that the sights are out of alignment and, therefore, can adjust accordingly. Turning to vertical alignment, notch 60 includes base 180 which is flat to help with vertical alignment by providing a reference with the top of front sight 20. In addition, sights 10 and 20 are aligned vertically when the top edge of the front sight is in alignment with edges 140 and 142.

Side walls 62 and 64 further include forwardly facing surfaces 200 and 202, respectively, which are arcuate and preferably are radiused with a radius of 0.219 inches. However, this radius can range between 0.175 inches and 0.300 inches or preferably in the range of 0.200 inches to 0.250 inches. Surfaces 200 and 202 have a forward or leading edge 204 and 206, respectively, adjacent top surface 56.

In order to protect the user while clearing a "stove pip jam" also discussed above in detail, the edges between forward facing surface 200 and outer surface 68, and between surface 200 and surface 88 are soften or broken. In similar fashion, the edges between forward facing surface 202 and outer surface 70, and between surface 202 and surface 90 are also soften or broken.

Referring to FIGS. 10-13, another embodiment is shown. This particular embodiment is configured to allow the sight to be used in direct replacement to the gun sight which is sold by the gun manufacturer. In this respect, all gun manufacturers provide what will be referred to as a stock sight in connection with the particular gun. The stock sight is designed to allow the gun to operate right out of the box and provides a means to aim the gun. Sight 310 includes a front surface 312, a rear surface 314, and side surfaces 316 and 318. Sight 310 is proportioned based on the particular gun in which the sight is to be used. In this respect, as is stated above, gun manufacturers provide a stock sight with its gun. The stock sight must be mounted to the gun in a way that rigidly secures the sight to the gun and which allows the user to remove the stock sight if it is damaged or if the user prefers a differently configured sight. Most gun manufacturers machine a slot in the gun for receiving the stock sight. In a semi-automatic handgun, as is shown in FIG. 1, the slot is machined on the upper surface of the slide transverse to longitudinal direction L. The stock sight is then press fitted into the machined slot such that the notch in the sight extends in the longitudinal direction and aligns with the front sight. Accordingly, if sight 310 is to be retained by this machined slot, it must be proportioned such that the sight can be press fitted into the slot in a similar fashion as the stock sight.

In order to allow rear sight 310 to be used in connection with a stock front sight (not shown), sight 310 can be proportioned so that notch 320, which will be discussed in greater detail below, is in alignment with a stock front sight. As can be appreciated, sight 310 can also be proportioned to work with a special front sight. Furthermore, as is known in the art, sight 310 can be produced in multiple configurations to allow for use with a wide range of guns. In addition, sight 310 can be manufactured in different heights to allow for sight adjustment. In this respect, gun manufacturers often produce front and rear sights having different heights to allow the user to adjust the sight based on manufacturer's variances, use with multiple guns and differences in shooting styles. The rear sight can be made in different heights such that one rear sight can replace another rear sight to raise or lower the shot by a set increment. This set increment can be half-inch increments, one-inch increments, more than one-inch increments or any desired increment. As a result, if the shooter, based on the shooter's particular sighting technique, discovers that his or her shot is off, the rear sight can be replaced with another rear sight based on the increment of change needed. In similar fashion, multiple front sights can also be made that are in similar increments or different increments. For example, the rear sight can be made in different heights such that the shot is adjusted in one-inch increments while the front sight is made in different heights to allow half-inch adjustments. Together, the front and rear sights can be interchanged to correct for manufacturing variances and/or for vertical sighting errors. While not necessary, it is preferred that sides 316 and 318 of rear sight 310 are lengthened or shortened to produce the different increments in rear sight 310.

Sight 310 has a base portion 330 which is designed to be received in the machined slot of the particular gun. Based on the depth of the machine slot, base 330 extends upwardly from a bottom surface 332. Extending upwardly from base 330 are side walls which define sight boundaries of a sight line SL similar to sight line SL described above with respect to sight 10. The boundaries of sight line SL include notch 320 and side walls 340 and 342 which extend upwardly from base 330. Side walls 340 and 342, each include outer surfaces 350 and 352 that are essentially symmetrical to one another and have inwardly tapered configuration similar to that of sight 10. In this respect, outer surfaces 350 and 352 include a first inwardly extending surface 354 and 356, respectively. First inwardly extending surfaces 354 and 356 can be radiused with the radius of approximately 0.0625 inches, however, this radius can vary based on the proportion discussed above based on the different sized slots produced by the gun manufacturers. Outer surfaces 350 and 352 further include a second upwardly extending surface 358 and 360, respectively, adjacent to surfaces 354 and 356. These surfaces 358 and 360 are also arcuate. Surfaces 358 and 360 can be radiused with a radius of 0.2187 inches, again, based on the proportion of the gun manufacturer's slot. Adjacent to second surfaces 358 and 360 are third surfaces 362 and 364, respectively. Third surfaces 362 and 364 extend upwardly and inwardly from surfaces 358 and 360, respectively. Surfaces 362 and 364 are also arcuate and can be radiused with a radius of 0.0625 inches. Third surfaces 362 and 364 blend into top surfaces 366 and 368, respectively. As with gun sight 10 described above, this side wall configuration reduces sight boundaries for the user which helps quicken target acquisition.

Notch 320 of this embodiment is also an upwardly opened notch that is centered horizontally in rear surface 314. Notch 320 is defined by a notch base surface 370 which can be generally horizontal. Notch 320 further includes notch side surfaces 372 and 374 that are essentially vertical. Notch base 320 is joined to notch sides 372 and 374 by arcuate corner portions 380 and 382, respectively. It is preferred that corner portions 380 and 382 are radiused and can have a radius of 0.0469 inches.

As with notch 60, base 370 of notch 320 can also be slightly angled from back to front to produce a crisp, well-defined notch base as the user looks through notch 320 towards front sight 20. In addition, top surfaces 366 and 368 can also be angled downwardly from back to front to also produce a clear, crisp and distinct edge for the user when looking through rear sight 310 toward front sight 20. The slight forward sloping of the surfaces can also reduce sun glare from the side surfaces. The edges between can also be slightly rounded to reduce the likelihood of injury if the sight engages ones hand. This is primarily a factor with the front edges of the sight.

As can be appreciated, notch 320 has a width, which is transverse to the longitudinal direction, between sides 372 and 374 which is dependent on the stock front gun sight produced by the gun manufacturer. However, if the front sight is also replaced, the width of notch 320 is preferably approximately between 0.125 inches and 0.150 inches. Notch 320 also has a length which extends in the longitudinal direction which is preferably 0.125 inches. As discussed above, reducing the notch length further reduces sight boundaries produced by the rear sight. In this particular embodiment, notch 320 essentially extends uniformly between rear surface 314 and front surface 312. However, gun sight 310 can also include a clearance groove to further reduce the sight boundaries of the rear sight. Additionally, the notch length could vary depending upon other embodiments. Other embodiments could also include clearance grooves to further reduce the sight boundaries of the rear sight.

In this embodiment, surfaces 312 and 314 are substantially the same and extend upwardly and toward one another from bottom 333. Surfaces 312 and 314 are generally planar and can include non-glare provisions such as non-glare coatings or paint.

Sight 310 can further include alignment dots 390 and 392 or night sights (not shown) which are known in the industry. The night sights can include tritium inserts. In addition, sight 310 can include any of the features described above with respect to sight 10. In this respect, and for example only; sight 310 can include a rear surface 314 which includes a surface portion near top 366, 368 that slants rearwardly from bottom to top. In order to accommodate night sights, the front of the sight can extend forwardly or the back of the sight can extend rearwardly based on governmental specifications on sight width when night sights are used. The rear surface can also include an undercut which is also known in the industry and which is not shown. Further, the alignment dots or night sights can be utilized in any of the above embodiments.

Figure 9:
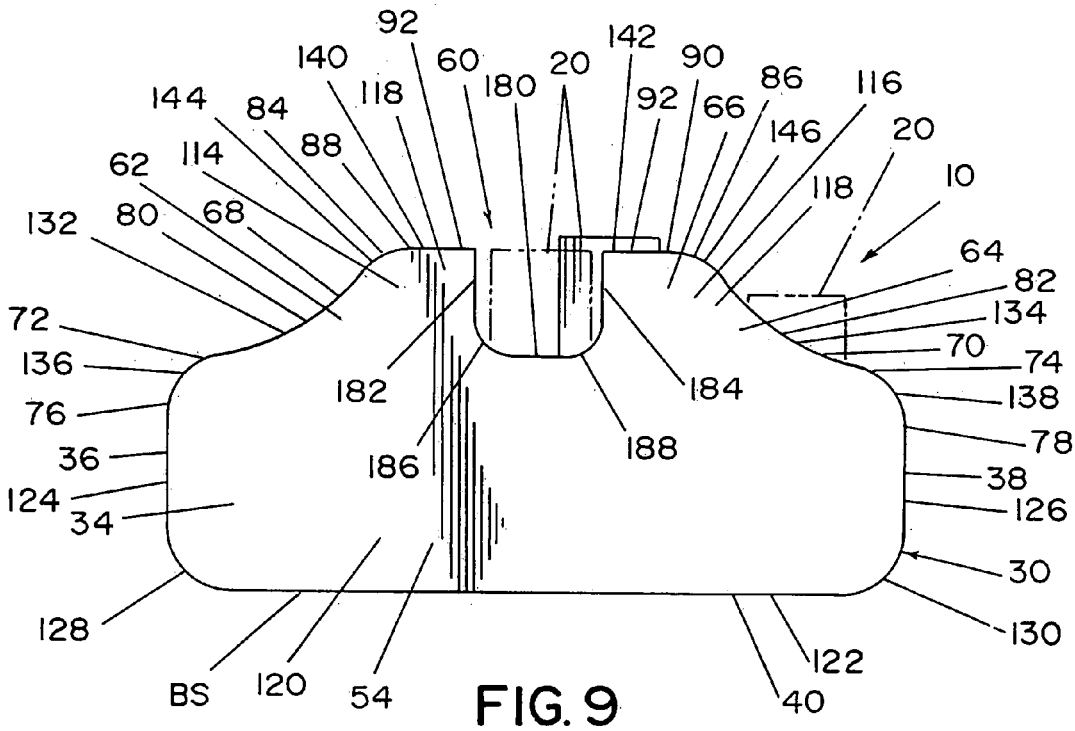
FIG. 9 is a rear elevational view of the rear tactical gun sight according to the present invention along with the front sight showing the alignment of the sights for target acquisition.
Figure 10:
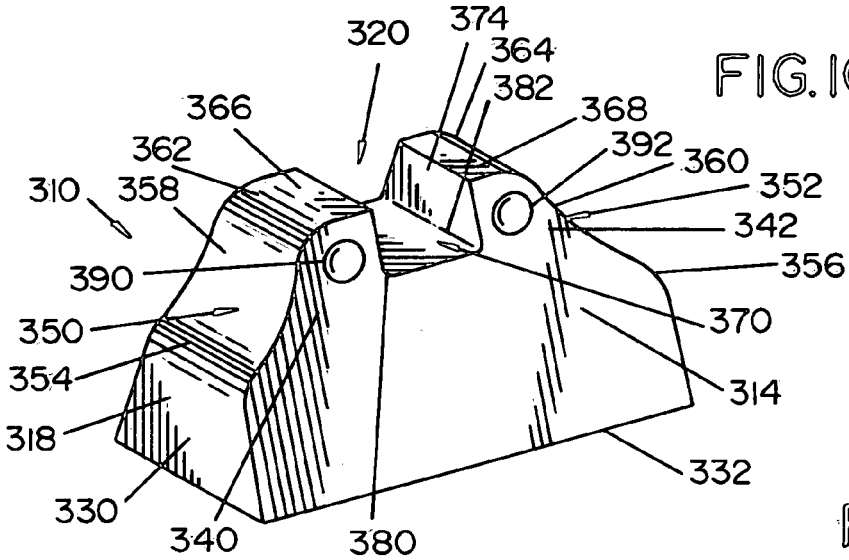
FIG. 10 is a perspective view of another embodiment of a rear tactical gun sight according to the present invention.
Figure 11:
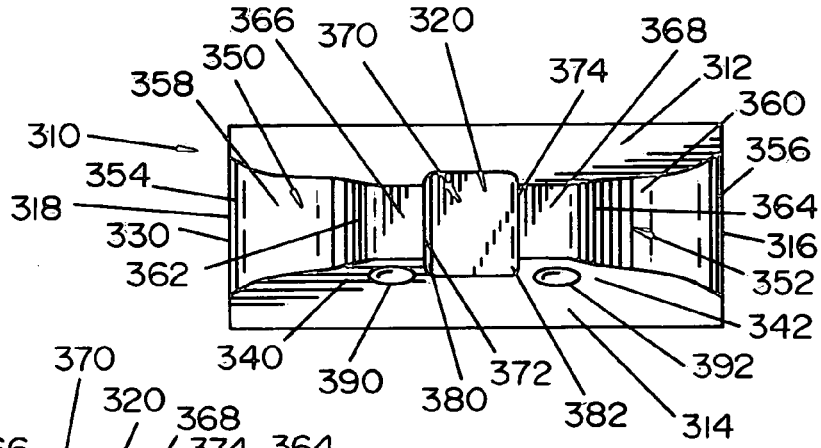
FIG. 11 is a top plan view of the gun sight shown in FIG. 10.
Figure 12:
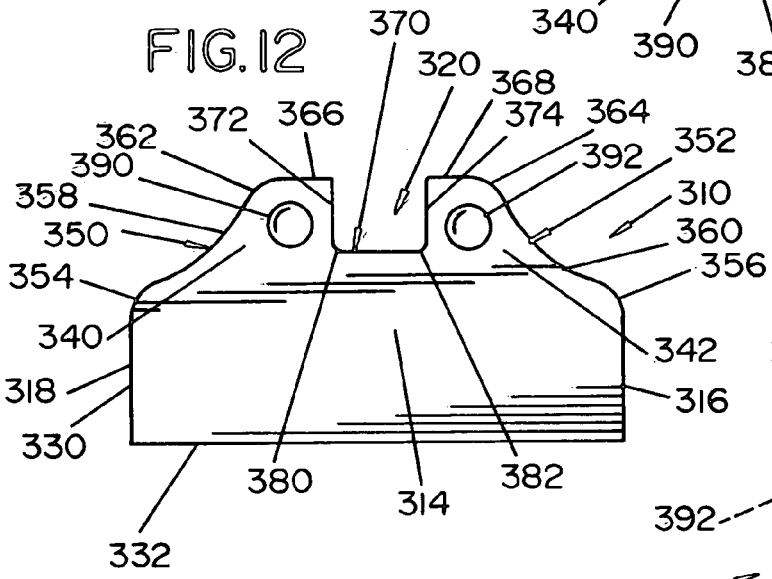
FIG. 12 is a rear elevational view of the gun sight shown in FIG. 10.
Figure 13:
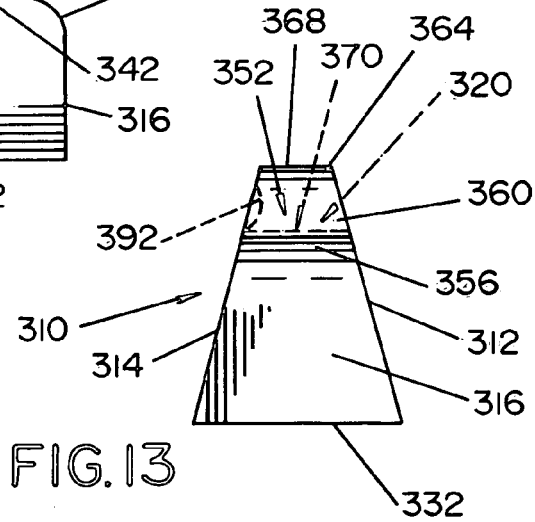
FIG. 13 is a side elevational view of the gun sight shown in FIG. 10.
Figure 14A:
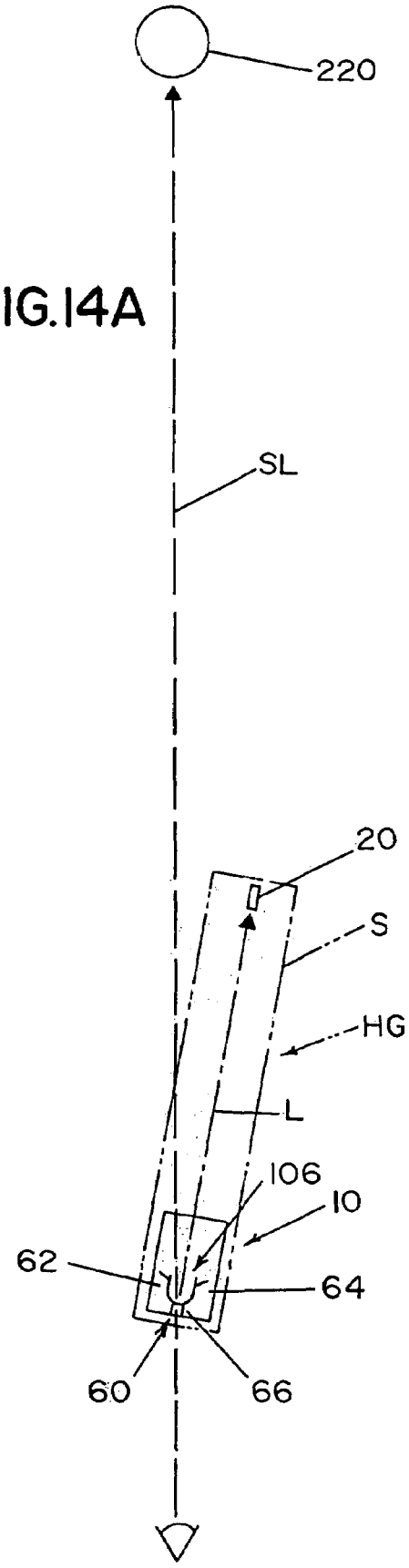
FIG. 14A is a schematic top view of the gun sight shown in FIG. 1 showing a sight line of the user; and, FIG. 14B is a view similar to FIG. 14A showing another sight line of the user and target acquisition.
Figure 14B:
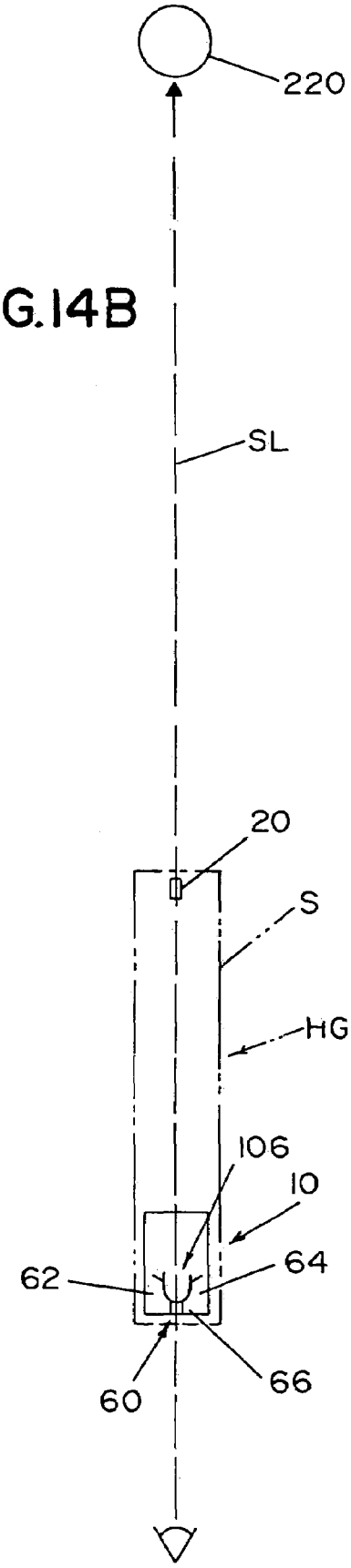

Referring to FIGS. 14A and 14B, shown are examples of sight boundaries and the alignment of front sight 20, rear sight 10 and target 220. While only rear sight 10 is shown in this example, it should be appreciated that any of the embodiments described in this application would have similar functional characteristics as sight 10 as described below. Starting with the sight boundaries within notch 60, the sight line SL is bound, in part, by the inner configuration of walls 62, 64 and 66. In this respect, if the user is looking through notch 60 toward front sight 20, the user can only see target 220 if a straight line can be drawn between the user's eye and target 220. Any obstruction of that line will prevent user from seeing the target. By shortening the length of notch 60 and by including clearance groove 106, even though hand gun HG in FIG. 14A is well out of line with target 220, target 220 can be seen by the user through notch 60. If either the notch length was increased or the clearance groove was removed, the user would not be able to see target 220 through notch 60 with the misalignment shown in FIG. 14A. As a result, sight acquisition time would increase. Turning to the outer configuration and FIG. 9, by having a small top edges 140 and 142 and tapered edges 132 and 134, either the front sight or target 220 can be easily seen by the user about side and notch walls 62, 64 and 66. Even if front sight 20 is below and off to the side of rear sight 10, the user will be better able to see the front sight and therefore be able to more quickly bring front sight 20 into proper alignment within notch 60. In addition, if front sight 20 is over the top edge of rear sight 10, by having a small top edge, the user will be able to more quickly bring the front sight 20 into alignment within notch 60. It should be appreciated that while FIG. 9 shows only front sight 20, in similar fashion, the configuration of rear sight 10 also helps the user view target 220 if it is in a similar relation to rear sight 10.

While considerable emphasis has been placed on the preferred embodiments of the invention illustrated and described herein, it will be appreciated that other embodiments can be made and that many changes can be made in the preferred embodiments without departing from the principles of the invention. Accordingly, it should be distinctly understood that the foregoing descriptive matter is to be interpreted merely as illustrative of the invention and not as a limitation.

Having thus described the invention, it is claimed:

1. A rear tactical sight for a handgun having a barrel with a barrel axis, said sight comprising a base extending in a longitudinal direction parallel to said barrel axis, said base having a back and an oppositely facing front, and sides extending in said longitudinal direction; said sight further includes a pair of spaced apart side walls extending upwardly from said base sides to a top sight surface and a notch wall extending between said side walls which includes an upwardly opened notch having a substantially horizontal notch base transverse to said longitudinal direction and substantially vertical notch sides adjacent either side of said notch base, said notch sides being joined to said notch base by symmetrical arcuate corner surfaces, said notch partially defining boundaries of a sight line for said sight, said side walls and said notch wall having back surfaces which are contiguous with one another and form a planar rear sight surface extending downwardly from said top sight surface, said side walls include outer surfaces that are substantially symmetrical to one another, each said outer surface including a first surface extending upwardly and inwardly from a corresponding one of said base sides respectively and a second surface extending upwardly from said first surface such that said first surface has a lower edge adjacent to a corresponding one of said base sides and extending inwardly toward an upper edge adjacent to a respective lower edge of said second surface.

2. The rear tactical sight of claim 1, wherein said notch corner surfaces are radiused and have a radius between 0.030 inches and 0.060 inches.

3. The rear tactical sight of claim 1, wherein said notch has a notch length in said longitudinal direction and a notch width transverse to said notch length, said notch width and notch length being approximately 0.125 inches.

4. A rear tactical sight for a handgun having a barrel with a barrel axis, said sight comprising a base extending in a longitudinal direction parallel to the barrel axis, said base having a back and an oppositely facing front with sides extending in said longitudinal direction between said back and front, and a bottom; said sight further including an upwardly opened notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface including a convex surface portion having a lower edge adjacent one of said base sides respectively and an upper edge adjacent a concave surface portion, said convex surface portion extending upwardly and inwardly from said respective side and said concave surface portion extending inwardly and upwardly, said base back is a bottom portion of a rear sight surface having a bottom edge adjacent said base bottom and upwardly extending side edges adjacent said base sides, said bottom edge and said side edges being joined by arcuate corner edges.

5. A rear tactical sight for a handgun having a barrel with a barrel axis, said sight comprising a base extending in a longitudinal direction parallel to the barrel axis, said base having a back and an oppositely facing front with sides extending in said longitudinal direction between said back and front, and a bottom; said sight further including an upwardly opened notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface including a convex surface portion having a lower edge adjacent one of said base sides respectively and an upper edge adjacent a concave surface portion, said convex surface portion extending upwardly and inwardly from said respective side and said concave surface portion extending inwardly and upwardly, said sight further includes a notch wall extending between said side walls such that said upwardly opened notch being is at least partially formed in said notch wall, said side walls and said notch wall having back surfaces which are contiguous with one another forming a rear sight surface that is substantially planar, said back surfaces of said notch wall and said side walls are contiguous with said base back, said rear sight surface including a portion of said base back, said rear sight surface including a bottom edge adjacent said base bottom and upwardly extending side edges adjacent said base sides, said bottom edge and said side edges being joined by first arcuate corner edges, said rear sight surface further including upper edges adjacent said side wall outer surfaces, said upper edges and said side edges being joined by second arcuate corner edges.

6. A rear tactical sight for a handgun having a barrel with a barrel axis, said sight comprising a base extending in a longitudinal direction parallel to the barrel axis, said base having a back and an oppositely facing front with sides extending in said longitudinal direction between said back and front, and a bottom; said sight further including an upwardly opened notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface including a convex surface portion having a lower edge adjacent one of said base sides respectively and an upper edge adjacent a concave surface portion, said convex surface portion extending upwardly and inwardly from said respective side and said concave surface portion extending inwardly and upwardly, said sight further includes a notch wall extending between said side walls such that said upwardly opened notch being is at least partially formed in said notch wall, said side walls and said notch wall having back surfaces which are contiguous with one another forming a rear sight surface that is substantially planar, said back surfaces of said notch wall and said side walls are contiguous with said base back, said rear sight surface including a portion of said base back, said rear sight surface being substantially smooth and including a sloped portion sloping rearwardly from bottom to top.

7. A rear tactical sight for a handgun having a barrel with a barrel axis, said sight comprising a base extending in a longitudinal direction parallel to the barrel axis, said base having a back and an oppositely facing front with sides extending in said longitudinal direction between said back and front, and a bottom; said sight further including an upwardly opened notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface including a convex surface portion having a lower edge adjacent one of said base sides respectively and an upper edge adjacent a concave surface portion, said convex surface portion extending upwardly and inwardly from said respective side and said concave surface portion extending inwardly and upwardly, said sight further includes a dovetail extending below said base.

8. The rear tactical sight of claim 7, wherein said each side wall further includes a second convex surface portion extending inwardly from said concave surface.

9. The rear tactical sight of claim 7, wherein said sight further includes a notch wall extending between said side walls such that said upwardly opened notch being is at least partially formed in said notch wall, said side walls and said notch wall having back surfaces which are contiguous with one another forming a rear sight surface that is substantially planar.

10. The rear tactical sight of claim 9, wherein said back surfaces of said notch wall and said side walls are contiguous with said base back, said rear sight surface including a portion of said base back.

11. The rear tactical sight of claim 7, wherein said sight further includes night sights in said side walls.

12. The rear tactical sight of claim 7, wherein said sight further includes a clearance groove between said side walls that further defines said boundaries of said sight line.

13. A rear tactical sight for a handgun having a barrel with a barrel axis, said sight comprising a base extending in a longitudinal direction parallel to the barrel axis, said base having a back and an oppositely facing front with sides extending in said longitudinal direction between said back and front, and a bottom; said sight further including an upwardly opened notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface including a convex surface portion having a lower edge adjacent one of said base sides respectively and an upper edge adjacent a concave surface portion, said convex surface portion extending upwardly and inwardly from said respective side and said concave surface portion extending inwardly and upwardly, said base forms at least a portion of a dovetail.

14. A rear tactical sight for a handgun having a barrel with a barrel axis, said sight comprising a base extending in a longitudinal direction parallel to the barrel axis, said base having a back facing the rear of the handgun, a front facing the front of the handgun, sides extending in said longitudinal direction and a bottom; said sight further including a notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface includes a first surface extending upwardly and inwardly from a corresponding one of said base sides respectively and a second surface extending upwardly from said first surface such that said first surface has a lower edge adjacent to a corresponding one of said base sides and extending inwardly toward an upper edge adjacent to a respective lower edge of said second surface, said sight further includes a dovetail extending below said base.

15. The rear tactical sight of claim 14, wherein said each side wall further includes a third surface extending inwardly from said second surface such that said second surface has an upper edge adjacent to a corresponding one of said third surfaces.

16. The rear tactical sight of claim 15, wherein said first second and third surfaces are arcuate surfaces.

17. The rear tactical sight of claim 15, wherein said each side wall further includes a top surface which is generally parallel to the barrel axis and adjacent to said third surfaces.

18. The rear tactical sight of claim 14, wherein said first and second surfaces are arcuate surfaces.

19. A rear tactical sight for a handgun having a barrel with a barrel axis, said sight comprising a base extending in a longitudinal direction parallel to the barrel axis, said base having a back facing the rear of the handgun, a front facing the front of the handgun, sides extending in said longitudinal direction and a bottom; said sight further including a notch joined to said base and spaced above said base bottom which at least partially defines boundaries of a sight line for said sight and a pair of side walls spaced on either side of said sight line each having outer surfaces that are opposite to one another and which extend upwardly from said base sides, said outer surfaces being substantially symmetrical to one another; each said outer surface includes a first surface extending upwardly and inwardly from a corresponding one of said base sides respectively and a second surface extending upwardly from said first surface such that said first surface has a lower edge adjacent to a corresponding one of said base sides and extending inwardly toward an upper edge adjacent to a respective lower edge of said second surface, said base forms at least a portion of a dovetail.

* * * * *